US008038924B2

(12) United States Patent
Harnfeldt et al.

(10) Patent No.: US 8,038,924 B2
(45) Date of Patent: Oct. 18, 2011

(54) METHOD OF CONTROLLABLY CONVEYING AN OBJECT AND AN APPARATUS FOR CONVEYING A WEB

(75) Inventors: Lars-Olof Harnfeldt, Kavlinge (SE); Henrik Transtrom, Furulund (SE); Peter Lindberg, Malmo (SE); Bjorn Rodman, Loddekopinge (SE)

(73) Assignee: Tetra Laval Holdings & Finance S.A., Pully (CH)

( * ) Notice: Subject to any disclaimer, the term of this patent is extended or adjusted under 35 U.S.C. 154(b) by 1271 days.

(21) Appl. No.: 10/568,316

(22) PCT Filed: Aug. 17, 2004

(86) PCT No.: PCT/SE2004/001203

§ 371 (c)(1),
(2), (4) Date: Feb. 16, 2006

(87) PCT Pub. No.: WO2005/028313

PCT Pub. Date: Mar. 31, 2005

(65) Prior Publication Data

US 2006/0284329 A1 Dec. 21, 2006

(30) Foreign Application Priority Data

Sep. 19, 2003 (SE) ..... 0302493

(51) Int. Cl.
*B29B 7/00* (2006.01)

(52) U.S. Cl. ..... 264/328.1

(58) Field of Classification Search ..... 264/40.1, 264/328.1, 153; 425/122
See application file for complete search history.

(56) References Cited

U.S. PATENT DOCUMENTS 5,131,593 A 7/1992 Siegfried et al.

FOREIGN PATENT DOCUMENTS

| | | |
|---|---|---|
| EP | 1 110 867 A1 | 6/2001 |
| EP | 1 249 399 A1 | 10/2002 |
| EP | 0 949 992 B1 | 11/2002 |
| GB | 1023886 | 3/1966 |
| WO | 98/18608 | 5/1998 |

OTHER PUBLICATIONS

English language translation of Decision on Grant for corresponding Russian Patent Application No. 2006113114, issued Jun. 30, 2008.

*Primary Examiner* — Christina Johnson
*Assistant Examiner* — Larry Thrower
(74) *Attorney, Agent, or Firm* — Buchanan Ingersoll & Rooney PC

(57) ABSTRACT

The present invention relates to a method of controllably conveying an object. The method comprises the steps of determining an intended conveying of the object, dividing, on the basis of a predefined profile for a second section (G) of the conveying, the intended conveying of the object into a first section (F) and a second section (G), conveying the object the first section (F), conveying the object the second section (G), and, during the second section (G) of the conveying of the object, registering an actual position of a predefined element linked to the object. The present invention further relates to an apparatus for reducing this method into practice.

7 Claims, 4 Drawing Sheets

METHOD OF CONTROLLABLY CONVEYING AN OBJECT AND AN APPARATUS FOR CONVEYING A WEB

This application is a U.S. national stage application based on International Application No. PCT/SE2004/001203 filed on Aug. 17, 2004, and claims priority under 35 USC §119 to Sweden Application No. 0302493-2 filed on Sep. 19, 2003, the entire contents of which are incorporated herein by reference.

TECHNICAL FIELD

The present invention relates to a method of controllably conveying an object or intermittently conveying objects during which conveying or indexing an actual position of a predefined element linked to the object is registered.

The present invention further relates to an apparatus for processing a web of packaging laminate, comprising at least one processing station which is disposed to intermittently execute a processing operation on the web, a drive unit which is disposed to convey the web passed the processing station, a control unit which is disposed to control the conveying by the drive unit of the web, and a sensor unit which is disposed to register the position of a predefined element linked to the web.

BACKGROUND OF THE INVENTION

It has long been known to produce food packages of different types from packaging laminates. One commercially viable method is to continuously unite the longitudinal edges of a web and thereby form the web into a tube which is thereafter filled and sealed and severed transversely of the longitudinal direction of the web so that a number of cushion-shaped individual packages are formed. Depending upon the mutual orientation of the transverse seals and depending upon subsequent final folding, these packages may be given different configurations. Examples of such configurations are the tetrahedral package which is marketed by Tetra Pak under the name Tetra Classic®. Another example of such a package is the brick-shaped package which is marketed by Tetra Pak under the name Tetra Brik®. This generic type of package is well-known both to persons skilled in the art and consumers and will not be described in greater detail here. The brief description, given by way of introduction, of the method of realising such packages is also well-known to a person skilled in the art and will not be described in greater detail either. Only those details of such a filling machine as are encompassed by the inventive concept as herein disclosed and an understanding thereof will be described in greater detail.

During the last decade, it has become increasingly common practice to provide, above all, the traditional, brick-shaped packages with different types of opening arrangements. One type of opening arrangement is described in EP 949 992 A1. This opening arrangement is realised in that a hole is punched through the packaging laminate, whereafter this hole is covered by an opening arrangement which is injection moulded straight over the hole. The injection moulding is put into effect in that a moulding tool is placed on either side of the packaging laminate so that the mould cavity formed by the moulding tools completely encloses the previously punched hole. By injecting hot, mouldable plastic into the entire mould cavity, the hole is sealed. This type of opening arrangement is normally formed with a weaker portion which extends about a greater part of the circumference of the opening arrangement so that a consumer may open the package by breaking a part of the opening arrangement along the weakening.

In order to realise such an opening arrangement, it is important to be able to place the hole punched in the web in the correct position in the injection moulding station. EP 1 110 867 A1 describes how it is possible to employ the hole as a reference point for positioning thereof in the injection moulding station. The traditional method prior to this was to employ some form of guide mark in order to position the packaging laminate web both before the punching operation and then before the injection moulding operation. One problem which may thereby occur is that a sum total is made of two error tolerances so that the opening arrangement is not injection moulded over the hole within its mutual tolerances. By measuring the position of the hole for positioning before the injection moulding, this tolerance accumulation chain has been eliminated.

EP 1 110 867 describes a set of three punches and three injection moulding stations where three mutually subsequent packaging blanks are punched simultaneously and three mutually subsequent packaging blanks are provided with opening arrangements by injection moulding simultaneously.

Recently, there has been an increasing demand for small packages, so-called portion packages, for example of the order of magnitude of 150 ml and upwards. One problem which has thereby occurred is that the distance between the hole positions of two mutually adjacent packaging blanks will be so slight that it is difficult to construct injection moulding units which can be positioned so close to one another. EP 1 249 399 describes how this problem has been solved by first punching, for example, every second packaging blank and thereafter indexing one step so that the other packaging blanks are punched. Once all packaging blanks which lie adjacent one another have been punched, a longer indexing is put into effect (for example five steps) so that all punched packaging blanks are conveyed past the punch units.

In connection with this type of indexing, with short and long index steps, it has nevertheless been possible to observe a difficulty in achieving an acceptable level of repeatability in the positioning. Above all, this problem has been observed at high machine speeds. The indexing principle described in EP 1 249 399 functions excellently, but for certain machine construction and certain speeds the idea needs to be further developed in order to be able to meet the requirements for correct positioning within very narrow positioning tolerances.

SUMMARY OF THE INVENTION

It is, thus, one object of the present invention to realise a method of controllably conveying an object. A further object is to realise a method which will be able to be employed in a large number of different types of conveying and which, for these different types of conveying will nevertheless give consistent positioning.

These objects have been attained according to the present invention by a method of controllably conveying an object or of intermittently conveying objects to a desired position, the method being characterised by the steps of: determining an intended conveying or indexing distance of an object; on the basis of a predefined profile for a second section of the indexing, dividing up the indexing of the object into a first section and a second section; conveying the object the first section; conveying the object the second section; and during the second section of the indexing of the object, registering an actual position of a predefined element linked to the object and adapting, on the basis of the registered actual position of the predefined element, the second section of the indexing of the object so that the intended conveying or indexing of the object is attained.

It is to be understood that the expression "profile" in relation to a conveying here refers to a speed profile for a "speed/time" or a "speed/distance" curve, as will be further explained below.

By predefining a special profile for the second section of the intended conveying or indexing this may be adapted in order to give the most distinct and correct read-off, at the same time as the first section of the total conveying can be formed in the simplest, and thereby most rapid possible manner. It has thus become possible to unite the two otherwise apparently contradictory objects of as rapid indexing or conveying as possible with as exact indexing or conveying as possible. Moreover, it has been possible to realise a solution to the problem of how to be able to realise different types or lengths of the different indexing or conveying steps. By separating the second section and making this second section in compliance with a predefined profile, it will be ensured that the second section of the conveying may be formed in the same manner regardless of how long the total indexing is to be. By forming the system and controlling it so that the position of the predefined element (for example a hole in a packaging laminate web), is registered during the second section of the indexing, for each type of indexing (regardless of total length) the position will be registered during the same type of movement for all indexings. As a result, this makes it largely possible to eliminate most types of dynamic effects which may otherwise affect the correct positioning. When a mechanical system is to accelerate an object, this will imply that the mechanical system will per se be flexed. In this case, the term flexed is taken to signify, for example, stretching of belts, flank play in gears, elastic outward flexing of frames, in other words all types of mutual movement that can be generated in the system. Under a given acceleration, i.e. a certain force on the object, the mechanical system will undergo a certain flexing. Above all, there will be a considerable difference between an acceleration and a retardation, since all clearances or play in the system will instantaneously change direction. With the method according to the present invention of controlling the conveying, it has thus been ensured that all tolerance chains lie in the same manner regardless of whether the conveying distance is short or long.

The above described control system and method can, in principle, be employed for all types of conveying or indexing to a processing station of any kind. The problems which were previously considered and the solutions which are mentioned above are, however, substantially focused on processing and indexing of a packaging laminate which forms a relatively flexible web which may readily be bent around a roller or begin to undulate if the tensile stress in the web is too low. For example, it has proved to be advantageous if possible to read-off a hole in a packaging laminate web during the acceleration phase of the web, since the web is then taut and displays a clearly defined length without any undefined undulations. By dividing up the indexing into a first and second section, it is possible to form the speed profile for the second section so that there is an acceleration phase where it is to be expected to be able to read-off the position of the hole. With traditional indexing technology, it would be necessary in such an event to make the read-off in the introductory phase of the indexing. However, this would introduce a new error source since, in long indexing, it would entail a long conveying distance between read-off and final position which increases the risk that some mutual movement may take place, such as, for example, that a web slips in relation to a roller.

The above-described method may include methods where the conveying is arrested completely according to the first section before the second section is initiated, but in many cases it is to be preferred if it is possible to realise the division of the first section and the second section while maintaining movement.

Preferred embodiments of the present invention are apparent from the appended subclaims.

According to one preferred embodiment, the method according to the invention further includes the steps of adapting, on the basis of the registered actual position of the predefined element, the second section of the conveying of the object so that the intended conveying of the object is achieved. By such means, it is simply possible to adjust the speed of the object or the web and the total conveying or indexing so that, for example, the hole arrives at the correct position without needing to adjust the position of the subsequent processing station.

Advantageously, the profile for the second section of the conveying is predefined so that the position of the predefined element is registered during an acceleration phase of the profile of the second section of the conveying of the object. As was mentioned above, it is possible to ensure that the read-off of the position takes place during a point in time when the web is reliably taut without any undefined undulations which would otherwise have a negative effect on the final positioning.

According to one preferred embodiment, the web consists of a packaging laminate. As was mentioned above, the present invention is eminently suitable for indexing or conveying packaging laminate since this is a relatively flexible material. The term packaging laminate is taken to signify various types of packaging materials which are intended to be cut and folded together to form a package. One common example is a paper-based packaging laminate with inner and possibly also outer, liquid-tight coatings of a plastic material. Other examples are various single-ply or multiply material of plastic or paper. It is also usual practice to provide such packaging laminate with a barrier of, for example, aluminium foil.

According to one preferred embodiment, the predefined element consists of a hole formed through the web. As was mentioned above, the present invention is eminently suitable for indexing and conveying a web in a machine which is disposed to intermittently provide a packaging blank with an opening arrangement which covers a hole in the web.

According to yet a further preferred embodiment, the method further comprises the steps of, on a first occasion, determining the intended conveying of the object to a first distance and, on a second occasion, determining the intended conveying of the object to a second intended distance which is separate from the first distance, to divide, on the basis of the same predefined profile, the first intended distance and the second intended distance each into a set of first and second sections of the conveying, the intended second section of each respective intended distance being equal and the first section of each respective intended distance being formed to be unequal in order to achieve different total intended distances. By such means, a method will be obtained of catering for different lengths of the total indexing and nevertheless maintaining the desired predefined second section of the indexing. This method of controlling the apparatus is eminently suitable for the system described by way of introduction comprising three mutually adjacent processing stations which are run at so-called 1:5 indexing (i.e. 1 step and 5 steps alternately). The second section remains adapted for correct position registration, while the first section is formed so as to realise, in the quickest possible manner, the remaining portion of the total length of the conveying or the indexing.

Advantageously, the method is adapted to realise a first total conveying, in that the object a) is accelerated and retarded or b) is accelerated, run at substantially constant speed and retarded during the first section of the conveying before the second section of the conveying is initiated. By such means, it is possible to realise a rapid indexing of the first section and nevertheless achieve a state which is adapted in order that the second section will be able to be initiated in a uniform manner.

Preferably, the retardation in the first section of the conveying continues until a predetermined position, predetermined time or a predetermined speed has been reached, whereafter the object is run at a constant speed during a predetermined time or along a predetermined travel before the second section of the conveying is initiated. By such means, it is possible to avoid the risk that dynamic effects from the first section of the indexing are propagated and affect the positioning in connection with the second section of the indexing. The choice as to whether to retard to a certain position, during a predetermined time or to a certain speed is largely determined by the relevant practical application. If there is a large inherent inertia (and thereby great kinetic energy) in the object which is being conveyed, it may, for example, be advantageous to ensure that a correct speed is achieved, since even slight differences in speed give rise to major dynamic differences. In many cases, the use of position is desirable since it is then possible to employ the intelligence inherent in most servo systems. If the servo system is provided with information as to the end position, the servo will, within predefined limit values of acceleration, maximum speed and retardation, automatically displace the object to this position in the quickest possible manner. The choice of length of time or distance and whether it is distance or time which is the essential parameter for control during the constant movement before the second section of the indexing is determined to a great extent by the practical field of application in question.

Advantageously, the method is adapted so as to realise a second total conveying in that the object is accelerated to a predetermined position, a predetermined time or a predetermined speed has been reached, whereafter the object is driven at constant speed during a predetermined time or along a predetermined distance before the second section of the conveying is initiated. By such means, it is simple to ensure that the second section of the indexing is realised in accordance with the predefined profile even if the first section of the indexing in principle solely encompasses one initial acceleration. To repeat, it is largely the relevant practical application which determines the parameter which is most important to employ for the controlled transition between the first and the second sections of the total indexing.

The above-outlined objects have also been attained according to the present invention by means of an apparatus for processing a web of packaging laminate, comprising at least one processing station which is disposed to intermittently execute a processing operation on the web, a drive unit which is disposed to convey the web past the processing station, a control unit which is disposed to control the conveying by the drive unit of the web in accordance with the method as set forth in any of appended claims 1 to 8, and a sensor unit which is disposed to register the position of the predefined element linked to the web.

As was mentioned above, the described method is above all suitable for use in an apparatus for applying opening arrangements on a packaging laminate web. Also in that case where there is only one processing station, the method according to the present invention is advantageous to employ, since it is possible to realise a read-off during a uniform acceleration phase which lies relatively close to the final positioning. Moreover, the system is, in such an event, adapted to be able to drive longer indexings in those cases this is necessary. For example, it may be necessary during an introductory phase to make longer indexings until the correct initial position has been arrived at.

Advantageously, the apparatus for realising an opening arrangement on a packaging laminate web comprises at least one hole making station which is disposed to realise a through-going hole in the web and at least one application station which is disposed to cover the hole with an opening arrangement. By such means, it is possible, as was mentioned previously, to provide a packaging laminate web with opening arrangements with the correct positioning.

Preferably, said at least one application station comprises at least one injection moulding station with moulding tools which are disposed to enclose between them in a mould cavity a portion of the web which comprises a hole formed in said at least one hole making station. As was mentioned previously, this is an advantageous method of realising opening arrangements which cover the hole formed in the packaging laminate web.

BRIEF DESCRIPTION OF THE DRAWINGS

The present invention will now be described in greater detail hereinafter with reference to the accompanying schematic drawings which show, for purposes of exemplification, currently preferred embodiments of the present invention.

DETAILED DESCRIPTION OF PREFERRED EMBODIMENTS

Figure 6:
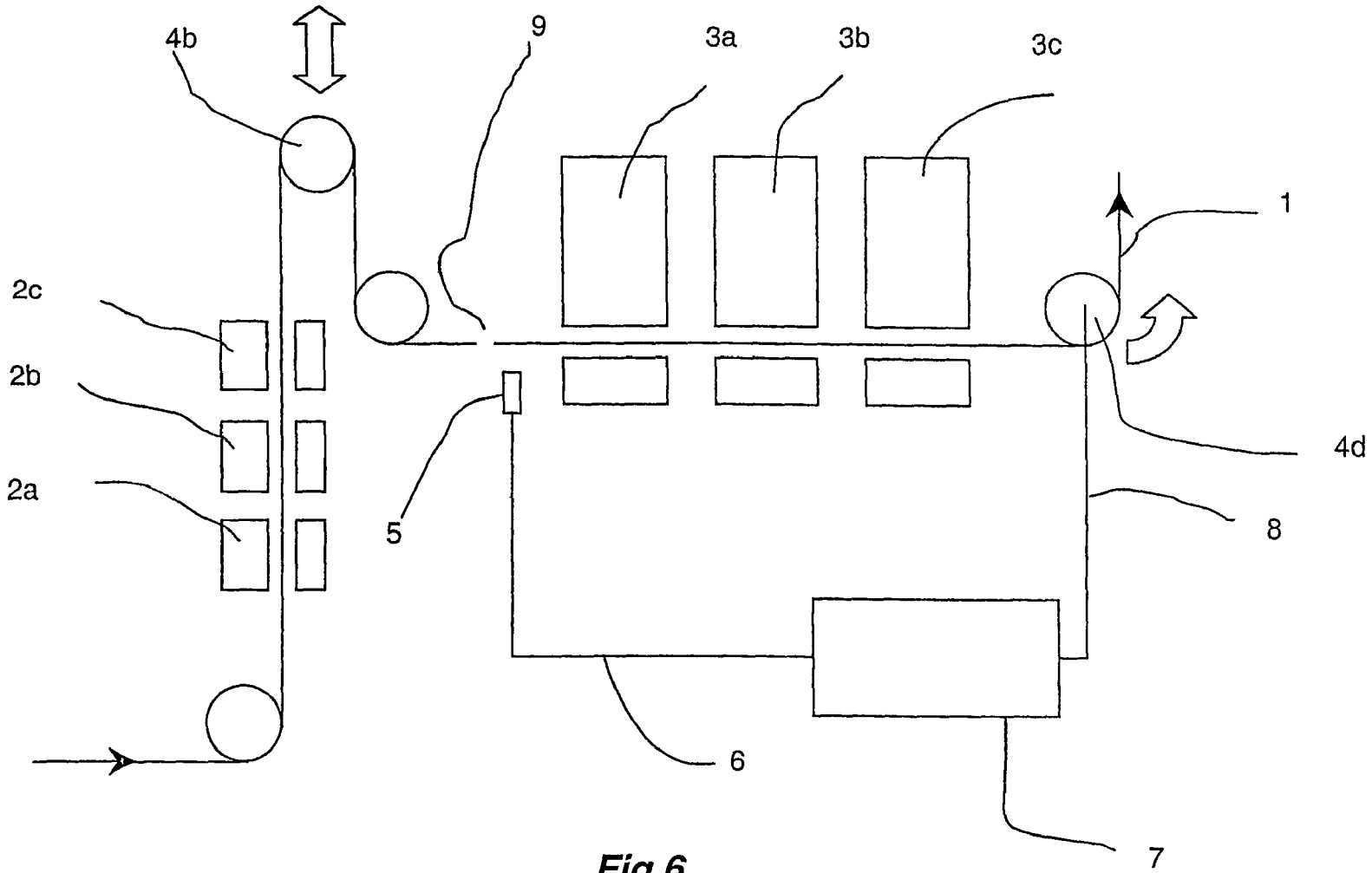
FIG. 6 schematically illustrates an apparatus for applying opening arrangements on a web of packaging laminate.

As is apparent from FIG. 6, the apparatus for applying opening arrangements on a web 1 comprises three punching stations 2*a-c* and three injection moulding stations 3*a-c*. The web 1 is driven past these stations over a number of rollers 4*a-d* which may be driving, retarding or freely rotating. In order to be able to take up differences in web positioning between the punching stations 2*a-c* and the injection moulding stations 3*a-c*, some of the rollers 4*b* may also be displaceably journalled so that a loop of the web 1 may be made smaller or larger as needed. FIG. 6 shows one embodiment where the extent of the web 1 through the injection moulding stations 3*a-c* is substantially driven by the subsequent roller 4*d*.

As was mentioned by way of introduction, the injection moulding stations 3*a-c* are described in greater detail in EP 949 992 A1. The three punching stations 2*a-c* may be of optional conventional type and will not be described in greater detail here. Each one of the punching stations is provided with a punch and an abutment on the other side of the web 1.

The apparatus is further provided with a sensor 5 which is disposed to be able to read-off when a hole 9 punched in the web 1 in a punching station 2*a-c* passes. The sensor 5 transmits a signal 6 to a control unit 7. The control unit 7 transmits in turn a signal 8 to the driving roller 4*d* to control the web 1 so that the holes 9 read-off by the sensor 5 will arrive at the correct position in relation to the injection moulding station 3*a-c*. As was mentioned above, an apparatus of this type requires that special indexing sequences are introduced if it is to be possible to make sufficiently small packages. This problem and different types of indexing sequences are described in detail in EP 1 249 399 and will not, therefore, be described in greater detail in this specification. Regardless of which indexing sequence is selected, the indexing- or conveying profile according to the present invention may be employed to improve the final positioning of the holes 9 in the injection moulding stations 3*a-c*.

Figure 3:
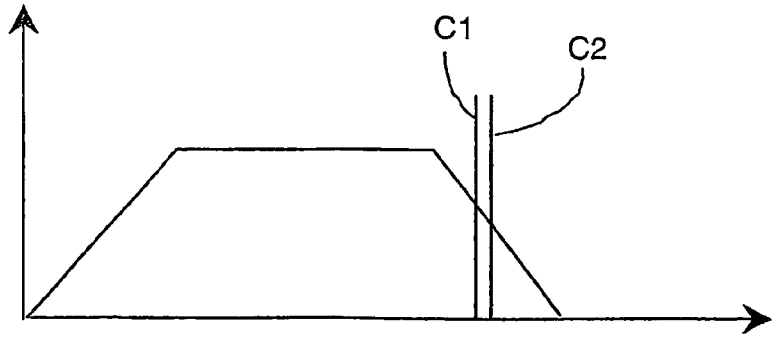
FIG. 3 schematically illustrates the speed profile according to prior art technology.

FIG. 3 shows a traditional speed profile over the time for a relatively long indexing. The web 1 if first driven in an acceleration phase in order subsequently to change into a constant speed phase in order finally once again to be retarded to stationary. As will be apparent from FIG. 3, a hole 9 is read and gives a signal C which indicates the passage of the first C1 and the second C2 hole edge. The first and second edges are detected and transmitted as a signal to a control unit. These signals are represented in FIG. 3 by two vertical lines C1, C2.

Figure 1:
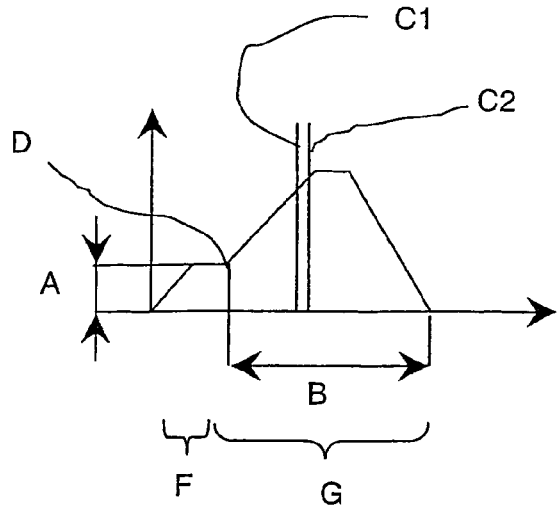
FIG. 1 schematically illustrates the speed profile over the time for a relatively short conveying step.
Figure 2:
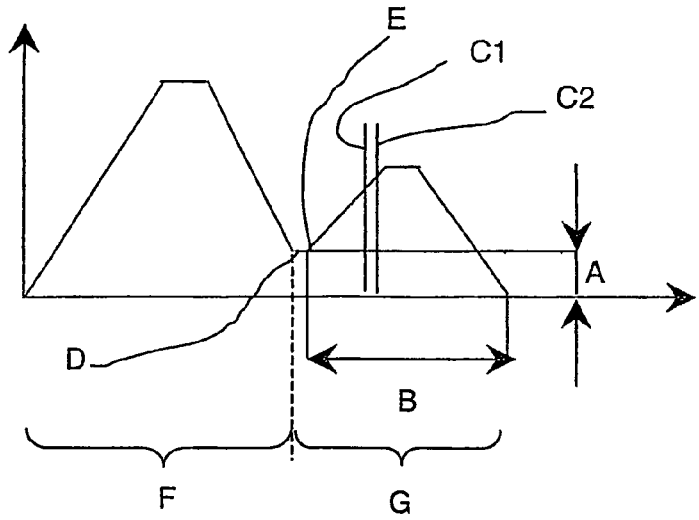
FIG. 2 schematically illustrates the speed profile for a relatively long conveying step.
Figure 4:
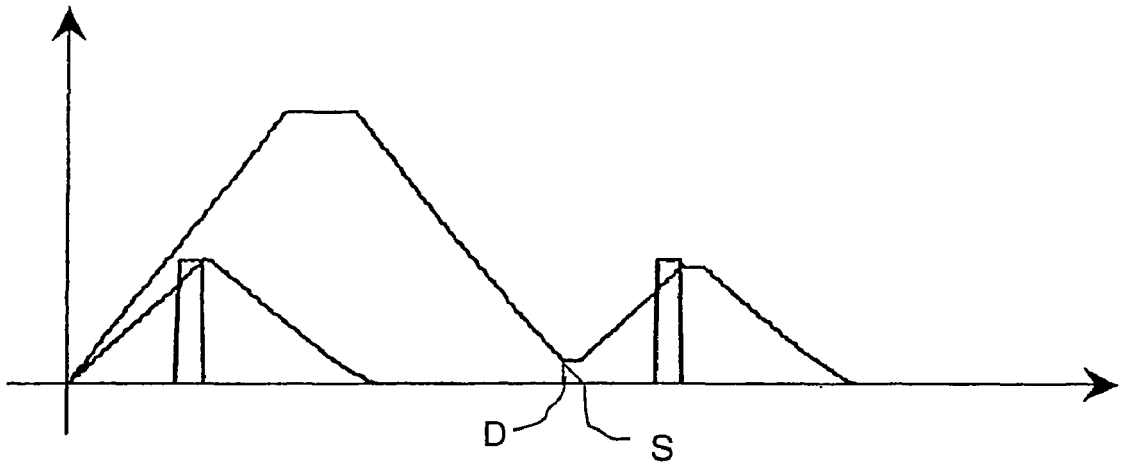
FIG. 4 schematically illustrates the speed profile for one relatively short conveying step and one relatively long conveying step.

FIGS. 1 and 2 illustrate, in accordance with the present invention, two different profiles which are intended for relatively short indexings and relatively long indexings, respectively. Both of them have been realised in terms of control engineering in the same manner. In this case, the technique will be described when the driving roller is a part of a servo system with a certain inherent intelligence where the servo system constitutes a logical part of the control unit. First, the servo system is provided with information that it is to run a certain distance S (possibly, a maximum acceleration, a maximum speed and a maximum retardation may also be defined). On the basis of this given distance S (see FIG. 4), the servo system will accelerate, drive further at a constant speed and finally begin to brake (as shown in FIGS. 2 and 4). When it has almost arrived at the end, or as late as possible before reaching S, it is given new information. In FIG. 1, this new body of information is given already before it has reached maximum speed. In FIG. 2 and FIG. 4, this information is given just before it has stopped again. In FIG. 1, FIG. 2 and FIG. 4, the position for this point in time is marked when a new information is given by reference numeral D. In FIG. 1 and FIG. 2 are shown examples where this point in time is determined by a certain speed A. Naturally, a given position or a given point in time may also be employed. Employing a position is advantageous, since most servo systems have integrated pulse counters which keep track of the position. Once this signal with information has been given, the servo system is driven at constant speed for a brief period of time. This time is determined by how quickly it is necessary to carry out the entire indexing and how quickly any possible oscillations reduce in the system during constant operation. If use is made of a position or a point in time for controlling the point for new information, it may be suitable to continue at the speed the web happens to be driven at at that point in time. As will be apparent from the foregoing description, a similar state has thus been arrived at regardless of whether a long or a short indexing has been driven.

After a given period of time (reference numeral E), the servo system is given new information as to an intended final position and within which acceleration-, retardation- and speed limits the system may run. The servo system will accelerate the web and the first C1 and second C2 edges of the relevant hole 9 will be read-off. In FIG. 1, the relevant hole 9 is the first hole, while in FIG. 2, the relevant hole 9 is number five in the sequence. Which hole is read-off and how many which have been read before but not employed for controlling the positioning depends, as was mentioned above, on what indexing principle is employed. The acceleration time or the acceleration distance has been selected so that there is time to read both the first and the second edge during the acceleration. For example, it is possible to employ the last edge read-off as a new point for controlling the servo system. When both of the edges have been read-off, it is possible to calculate the position of the hole in relation to the expected stop position. Thereafter, new information is given to the servo system as to how the final position indicated before the read-off is to be adjusted in order for the desired final position to be achieved.

The long indexing will now be described in brief with reference to FIG. 4.

1) Determine how far the indexing is to take place, i.e. the length of a packaging blank multiplied by the number of packaging blanks which are to be advanced past.

2) Determine whether this length makes it possible to have time to make two accelerations and retardations, i.e. if the intended indexing length is greater than the predefined profile.

3) Determine the first indexing distance S which is the total indexing minus the length of the predefined profile.

4) The first indexing distance S plus acceleration limit, retardation limit and maximum speed are given to the servo system.

5) Immediately before the first indexing distance S has been completed, the signal is given that the servo is to run the total indexing distance at maintained speed.

6) When a number of milliseconds have elapsed, a new signal is given to the servo system. Run the total indexing distance and that acceleration and retardation are permitted within certain limits, and also that maximum permitted speed has been set at a higher level. In order to arrive there in the quickest manner, the servo system will thus accelerate the web.

7) Read off the first hole edge and the second hole edge. Calculate a new value of end position. The new value of end position is given as the centre of the hole (i.e. the position of the first hole edge plus the position of the second hole edge and division of the total by two), plus a fixed distance which is geometrically determined by the distance between the sensor and the centre point in the injection moulding station.

8) Possibly, there may be an opportunity to adjust the last calculated value using some form of operating panel in connection with the control unit. This adjustment may be employed for finally adjusting the positioning in relation to any possible incorrect mounting of the sensor.

Figure 5:
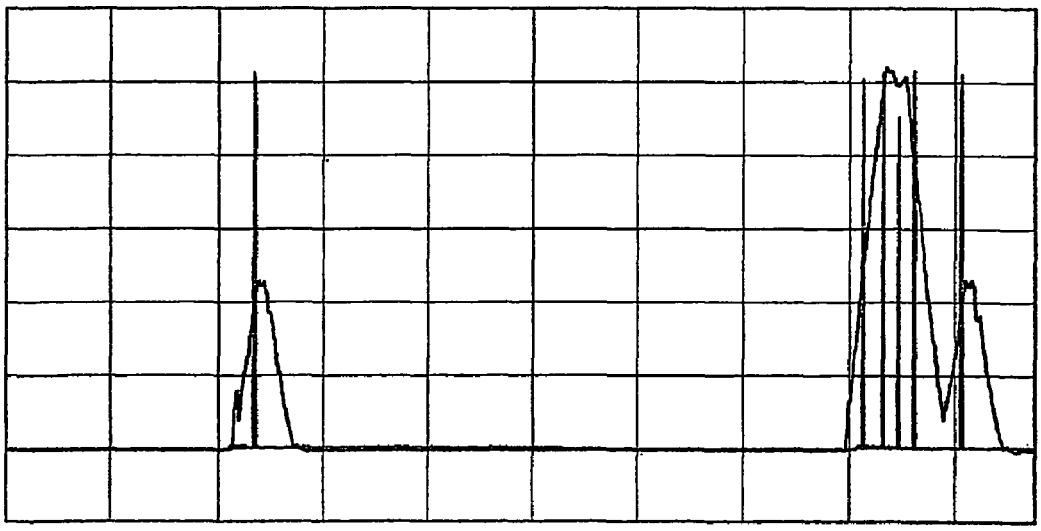
FIG. 5 shows measurement data from a short indexing of one step followed by a long indexing of five steps.

FIG. 5 shows a measured speed profile for a one-step indexing with read-off of a hole followed by a five-step indexing with read-off of five holes where the first four holes are registered during the first section of the indexing and the last, in other words that hole which is employed for adjusting the end position, is read-off during the last section of the indexing. In FIG. 5 it will be seen how the first section of the indexing takes place at high speed and that the second section of the indexing takes place with a profile which is the same as the profile which is employed during the last section of the one-step indexing. Both the first and the second speed profiles are run in accordance with the above-described composite profile. In the first profile, the first section has, however, only become an acceleration phase.

Figures 7A, 7B, 7C:
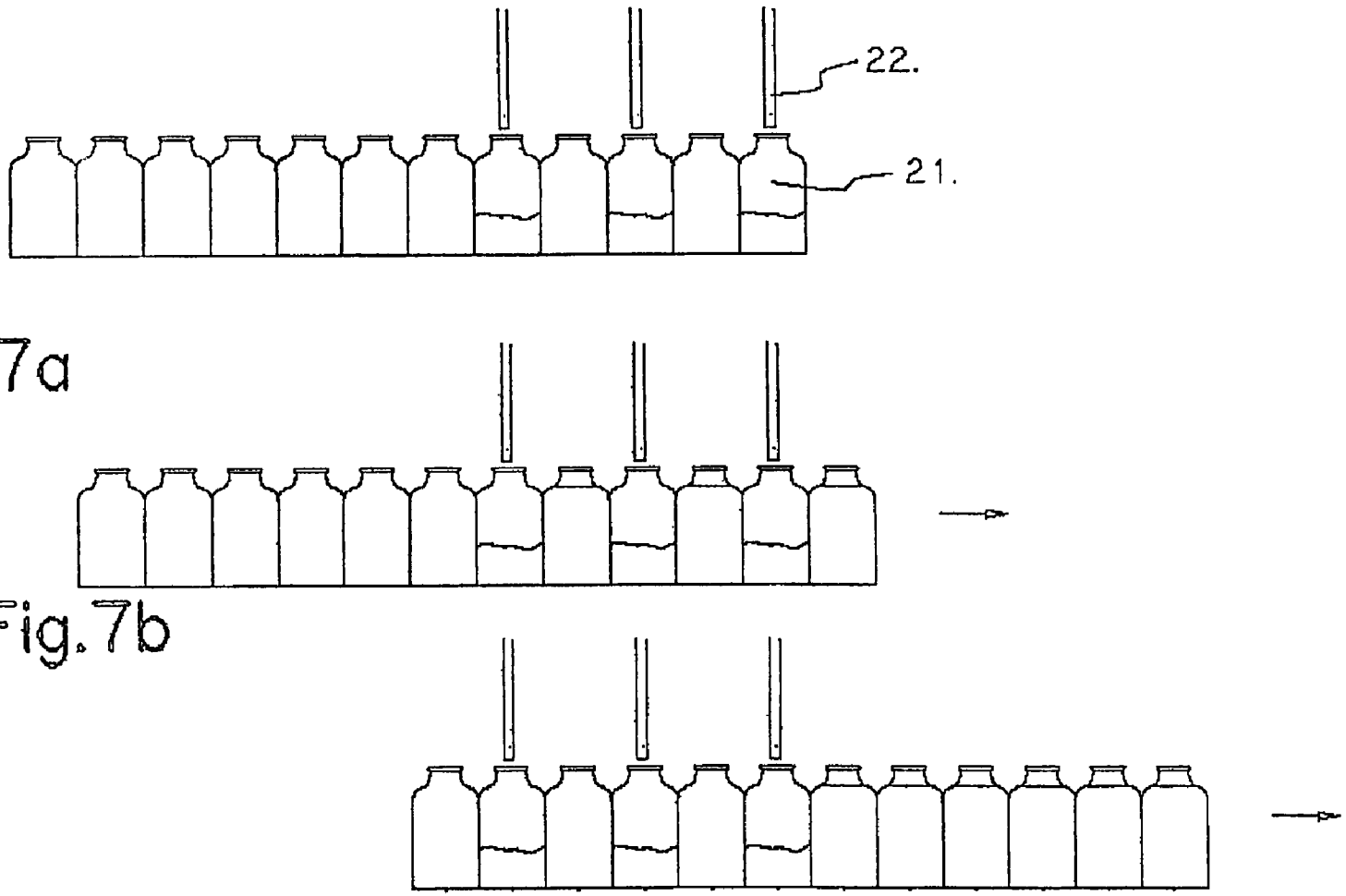
FIG. 7 schematically illustrates an alternative embodiment of the invention.

In an alternative embodiment, the invention can be used in a top filling station for packages. With reference to FIG. 7*a-c*, a row of packages 21 are controllably conveyed passed a filling station with three outlets 22 for dispensing a product to one package each. In FIG. 7*a*, package 1, 3 and 5 are filled and than an conveying of the packages are executed a distance corresponding to one package, arriving at the position illustrated in FIG. 7*b*.

In the position of FIG. 7*b*, the packages 2, 4 and 6 are filled and than a second conveying of the packages are executed a distance corresponding this time to five packages, arriving at the position illustrated in FIG. 7*c*.

By providing means for detecting the inlet holes in or reference marks on the packages (acting as predefined element linked to the package), the conveying of the packages can with advantage be performed using the method according to the present invention. The intended two different indexings or conveying distances are in this example corresponding to one and five packages and the respective distances are in turn divided into two sections. The second section of both distances being identical and includes the reading of the actual position of a hole or reference mark to secure correct positioning of the package at the end of said distance. Hereby, irrespectively of the actual distance being one or five packages, the second section G of each conveying distance always is the same and always includes a reading of the actual position of a hole or reference mark to secure precision positioning of the conveyed package at the end of the indexing or intenden conveying.

For example:

Conveying 1=1 package=$F1+G$

Conveying 2=5 packages=$F2+G$ were G=½ package, F1=½ package and F2=4½ package When starting Conveying 1, the first information given to a servo motor comprises the distance of travel corresponding to ½ package which gives a profile for F1. Then the predefined profile for G is initiated and a reading of actual position is performed during G and the predefined profile, if needed, is adjusted to secure the arrival in a correct position.

When starting Conveying 2, the information given to the servo motor comprises the distance of travel corresponding to 4½ package, which gives the profile for F2. Thereafter the predefined profile for G is initiated and a reading of actual position is performed during G and the predefined profile, if needed, is adjusted to secure the arrival in a correct position.

It will be readily perceived that numerous modifications of the embodiments of the present invention described herein are possible without departing from the scope of the invention as this is defined in the appended Claims.

For example, the sensor may be employed to read-off some other predefined element, such as a bar code or the like. Since the apparatus and the method according to the present invention make for narrower tolerance limits, it is possible to employ other read-off principles which in turn add different tolerances to one another.

In the specification, it is shown how different signals within the system are led via conductors, such as, for example, electrical or optical conductors, but it is naturally possible to employ wireless communications which, for example, utilise different types of electromagnetic waves.

Instead of adjusting the last part of the conveying of the web, it is possible in certain cases instead to adjust the position of the injection moulding stations once the passage of the holes has been read-off and their expected stop position calculated. Above all, this would be of interest in those cases where there is a web or an object to be conveyed which displays great inertia which may be adjusted positionally only with difficulty.

The invention claimed is:

1. A method of controllably conveying or intermittently conveying a web of packaging laminate provided with holes to at least one application station which is disposed to cover said holes with opening arrangements, comprising the following sequential steps:

determining a single intended conveying or indexing distance of the web;

on the basis of a predefined profile for a second section of the indexing, dividing up the single intended indexing distance of the web into a first section and a second section;

conveying the web the first section;

conveying the web the second section; and during the second section of the indexing of the web, registering an actual position of a pre-made hole in the web and adapting, on the basis of the registered actual position of the hole, the second section of the indexing of the web so that said hole arrives at a correct position in relation to an application station for applying an opening arrangement over said hole at a predetermined acceleration, thereby providing similar conditions each time an opening arrangement is applied.

2. The method as claimed in claim 1, further comprising predefining the profile of the second section of the indexing so that the position of the hole is registered during an acceleration phase of the profile of the second section of the indexing of the web.

3. The method as claimed in claim 1, wherein the opening arrangement is applied over said hole by injection moulding the opening arrangement with moulding tools which are disposed to enclose between them in a mould cavity a portion of the web which comprises the hole.

4. The method as claimed in claim 1, further comprising determining, on a first occasion, the intended conveying or indexing of the web to a first intended indexing distance and, on a second occasion, determining the intended conveying or indexing of the web to a second intended indexing distance which is separate from the first distance, dividing, on the basis of the same predefined profile, the first intended indexing distance and the second intended indexing distance each into a set of first and second sections of the indexing, the intended second section of each respective intended indexing distance being formed equally and the first section of each respective intended indexing distance being formed differently so as to achieve different total intended indexing distances.

5. The method as claimed in claim 1, wherein a first total indexing is realised so that the web a) is accelerated and retarded or b) is accelerated, run at substantially constant speed and retarded, during the first section of the indexing before the second section of the indexing is commenced.

6. The method as claimed in claim 5, wherein the retardation in the first section of the indexing continues until a predetermined position, a predetermined time or a predetermined speed has been attained, whereafter the web is run at constant speed during a predetermined time or along a predetermined distance before the second section of the indexing is commenced.

7. The method as claimed in claim 1, wherein a second total indexing is attained in that the web is accelerated until a predetermined position, a predetermined time or a predetermined speed has been achieved, where after the web is driven at constant speed during a predetermined time or along a predetermined distance before the second section of the indexing is commenced.

* * * * *